US008305848B2

(12) United States Patent
Born et al.

(10) Patent No.: US 8,305,848 B2
(45) Date of Patent: Nov. 6, 2012

(54) TIMEPIECE MOVEMENT FITTED WITH AN INERTIAL COUPLING MECHANISM

(75) Inventors: Jean-Jacques Born, Morges (CH); Cédric Nicolas, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 498 days.

(21) Appl. No.: 12/628,366

(22) Filed: Dec. 1, 2009

(65) Prior Publication Data

US 2010/0135127 A1 Jun. 3, 2010

(30) Foreign Application Priority Data

Dec. 1, 2008 (EP) ..... 08020803

(51) Int. Cl.
*G04B 19/02* (2006.01)
*G04B 5/02* (2006.01)

(52) U.S. Cl. ..... 368/220; 368/208

(58) Field of Classification Search ..... 368/220, 368/208, 244
See application file for complete search history.

(56) References Cited

U.S. PATENT DOCUMENTS

| | | | | |
|---|---|---|---|---|
| 1,994,581 | A * | 3/1935 | Lazzarini | 74/336.5 |
| 2,135,917 | A * | 11/1938 | Seybold | 475/95 |
| 2,305,666 | A | 12/1942 | Bolsey | |
| 2,667,737 | A | 2/1954 | Gazda | |
| 2,739,682 | A | 3/1956 | Detwiler | |
| 2,756,559 | A | 4/1956 | Derr | |
| 2,874,532 | A | 2/1959 | Baier | |
| 3,019,595 | A * | 2/1962 | Murrle | 368/148 |
| 3,315,460 | A * | 4/1967 | Odenbach | 368/245 |
| 5,023,853 | A | 6/1991 | Kawata et al. | |
| 5,878,004 | A | 3/1999 | Miyauchi et al. | |
| 6,349,075 | B1 | 2/2002 | Miyauchi et al. | |
| 7,965,584 | B2 * | 6/2011 | Papi et al. | 368/245 |

FOREIGN PATENT DOCUMENTS

| | | |
|---|---|---|
| CH | 330 203 | 5/1958 |
| CH | 343 928 | 12/1959 |
| EP | 0 547 250 | 6/1993 |
| EP | 1 980 922 | 10/2008 |
| FR | 2 196 490 | 3/1974 |

OTHER PUBLICATIONS

Dictionary.com—Mesh—Jun. 1, 2012.*
European Search Report issued in corresponding application No. 08 02 0803, completed May 27, 2009.
Notice of Allowance issued in co-pending related application No. 12/628,529, mailed Oct. 27, 2010.

* cited by examiner

*Primary Examiner* — Sean Kayes
(74) *Attorney, Agent, or Firm* — Griffin & Szipl, P.C.

(57) ABSTRACT

A timepiece movement comprising a coupling mechanism including first and second coupling wheel sets, whereby the rotation of the first coupling wheel set causes the second coupling wheel set to rotate, whereby the coupling mechanism is a centrifugal coupling mechanism including an inertial click secured to the hub of the first coupling wheel set, and meshing with stop members secured to the second coupling wheel set.

6 Claims, 3 Drawing Sheets

TIMEPIECE MOVEMENT FITTED WITH AN INERTIAL COUPLING MECHANISM

This application claims priority from European Patent Application No. 08020803.6, filed Dec. 1, 2008, the entire disclosure of which is incorporated herein by reference.

FIELD OF THE INVENTION

The invention concerns timepiece movements that include mechanisms using an inertial coupling mechanism, and, in particular, movements of this type, which are automatically wound and have vibrating alarms comprising a gear train mechanism using such a coupling mechanism, and which are intended for wristwatches, pocket watches or suchlike.

BACKGROUND OF THE INVENTION

The patent application EP08020803.6, whose priority is claimed and the entire contents of which are incorporated here by reference, overcomes the drawbacks of the watches fitted with vibrating alarm mechanism known of the prior art, by supplying an automatically wound timepiece movement that includes a silent vibrating alarm mechanism advantageously using elements of the movement and generating a large amplitude vibration.

It further supplies a timepiece movement that includes an alarm device of this type, the design of which is particularly simple and inexpensive to implement.

The present invention deals more specifically with the coupling mechanism that can be preferably used in the frame of the vibrating alarm mechanism described hereabove, and whose coupling offers an alternative to the clutch wheel of the reverser type known in the prior art, for which the coupling is selective according to the relative sense of rotation of the wheel sets, but does not assign an intrinsic driving and respectively driven property to each of the wheel sets.

SUMMARY OF THE INVENTION

The invention therefore concerns a timepiece movement comprising a coupling mechanism including first and second coupling wheel sets, whereby the rotation of the first coupling wheel set causes the second coupling wheel set to rotate, whereby the coupling mechanism is a centrifugal coupling mechanism including an inertial click secured to the hub of said first coupling wheel set, and meshing with stop members secured to said second coupling wheel set.

An advantage of this mechanism is that it allows to define an always driving wheel set and an always driven wheel set, so that the coupling is asymmetric for gear trains located on each side of those wheel sets: one of those gearing train could drive the other one, whereas the opposite driving coupling will always be impossible.

Another advantage is that the coupling is depending on the rotation speed of the driving wheel set.

BRIEF DESCRIPTION OF THE DRAWINGS

Other features and advantages of the invention will appear clearly from the following description, made with reference to the annexed drawings, in which.

DETAILED DESCRIPTION OF THE PREFERRED EMBODIMENTS

Figure 1:
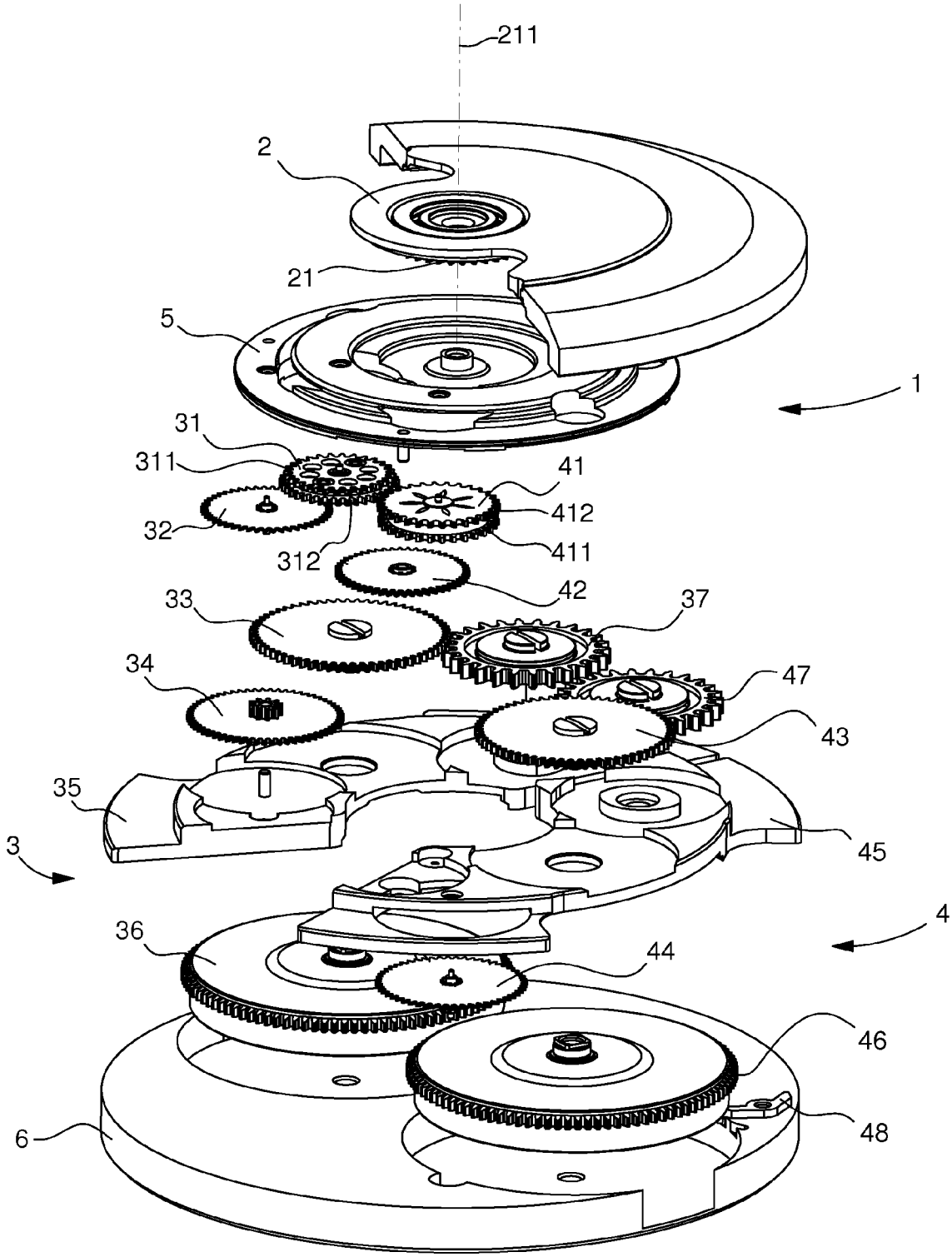
FIG. 1 is an exploded perspective view of one part of the movement forming a vibrating alarm using the coupling mechanism according to a preferred embodiment of the invention.

FIG. 1 shows an exploded perspective view of a timepiece movement 1 for a wristwatch using an inertial click according to a preferred variant of the invention. The timepiece movement 1 proposed associates a vibrating alarm mechanism with a timepiece movement that includes an automatic winding mechanism, known to those skilled in the art. This automatic winding mechanism of movement 1 uses the rotation of an oscillating weight 2 to store mechanical energy in a barrel 36 via a gear train 31, 32, 34 forming a kinematic chain 3, which meshes on weight pinion 21 of oscillating weight 2, which forms a toothed wheel. Because of the shift in the centre of gravity of oscillating weight 2 relative to its axis of rotation 211, which is also that of weight pinion 21, the user's wrist movements cause this oscillating weight 2 to rotate relative to the watchcase. The rotation of oscillating weight 2 causes ratchet wheel 33 of barrel 36 to rotate at the end of the kinematic chain. The rotation of ratchet wheel 33 winds the spring inside barrel 36 and thus stores mechanical energy, which will be distributed towards a going train (not shown) that meshes on the teeth of barrel 36. According to FIG. 1, this winding mechanism is of the type that only winds in one direction, owing to reverser wheel 31, the working of which will be explained below with particular reference to FIG. 3. Wheel sets 32 and 34 are reduction wheel sets that each include a coaxial, joined wheel and pinion and their purpose is to establish a suitable gear ratio for adjusting the rotational velocity to be obtained at the end of gear train 3 as a function of the velocity of weight pinion 21.

As shown in FIG. 1, the reverser wheel 31 is also rotatably mounted on support 5, which has suitable cut-out portions so that weight pinion 21 of oscillating weight 2 meshes with a first toothing 311 of reverser wheel 31, whereas a second toothing 312 of reverser wheel 31 meshes with the wheel of reduction wheel set 32. Reverser wheel 31 forms a "free wheel": in the first direction of rotation of oscillating weight 2, the first toothing of the first wheel set 311 of reverser wheel 31 is coupled to the second toothing of the second wheel set 312 of the reverser wheel, whereas in the second direction of rotation of oscillating weight 2, the first toothing 311 of reverser wheel set 31 is uncoupled from second toothing 312. The reduction wheel set 32 is rotatably mounted relative to support 5, and the pinion of reduction wheel set 32 meshes with a wheel of another reduction wheel set 34, rotatably mounted on a bridge 35, which is secured to bottom plate 6.

As illustrated in FIG. 1, a winding wheel 37 is rotatably mounted relative to bridge 35 and can be set in rotation by the user who wishes to wind the watch manually by activating a stem or crown that has an external knob (not shown). The energy stored in the spring (not illustrated) of barrel 36 can consequently be obtained either by rotating oscillating weight 2, or by manual winding.

Movement 1 includes a vibrating alarm mechanism 4, which includes an energy source 46, an activation device 48, a kinematic chain 4 and a vibrating element 2. According to the embodiment illustrated in FIG. 1, the energy source used for the vibrating alarm mechanism is a second barrel 46, independent of the first barrel 36 used for the going train. However, another energy source could be envisaged, for example an electric or electromechanical source, for powering the vibrating alarm device of the invention, and/or the normal time display. It is, for example, possible to apply the invention to an ETA Autoquartz type mechanism, in which the mechanical energy from the oscillating weight is used for powering a generator, coupled to an accumulator, which supplies electrical energy to a quartz motor. According to the invention, the activation device is a click 48, which locks barrel 46 in rotation outside the alarm times, but releases it exactly when the alarm is activated at a determined time, which can preferably be set by the user. When alarm 4 is activated at a determined time, click 48 pivots, leaving the toothing of barrel 46 free to rotate. A control device (not shown) pivots click 48 between a locking position, outside the alarm time, and a release position during the alarm time.

The vibrating element of the vibrating alarm mechanism is oscillating weight 2, which is driven in rotation at the end of a kinematic chain 4, driven by the rotation of barrel 46, and includes an activation mechanism 41 according to a preferred embodiment of the invention, described below with reference to FIGS. 4 to 6. The vibrating alarm mechanism is for generating a detectable vibration on the user's wrist; when the watch rests on a hard surface, the vibrations generated by the alarm mechanism will make the watch jump, which makes a noise upon impact with the surface, The vibrating alarm mechanism preferably includes a first reduction wheel set 44, formed of a pinion and a wheel, secured to each other in rotation, similar to reduction wheel sets 32, 34 of kinematic chain 3 associated with the automatic winding device of the movement. However, unlike wheel set 34 illustrated in FIG. 1, the pinion of reduction wheel set 44 is located underneath the wheel of the same wheel set and meshes directly with the toothing of barrel 46. Reduction wheel set 44 is rotatably mounted on a bridge 45, secured to bottom plate 6; its wheel meshes with the pinion of a second reduction wheel set 42, which is also rotatably mounted on bridge 45. The wheel of reduction wheel set 42 is coupled to an activation device 41, which includes first and second activation wheel sets 411, 412, arranged such that the rotation of the first wheel set causes the second wheel set 412 to rotate. The teeth of the wheel of reduction wheel set 42 mesh on the teeth of the first reduction wheel set 411, whereas the teeth of the second reduction wheel set 412 mesh on weight pinion 21 of oscillating weight 2.

When the alarm is activated, click 48 releases the energy stored in the spring of barrel 46 and sets the peripheral teeth of barrel 46 in rotation. The maximum energy stored in barrel 46 and the gear ratios of the gear train for kinematic chain 4, which drives first activation wheel set 411, can be determined such that oscillating weight 2, which acts as vibrating element, rotates for approximately 15 seconds after the alarm has been activated. Moreover, the gear ratios of reduction wheel sets 42, 44 for determining the rotational velocity ratio between barrel 46 and the oscillating weight, are calculated to be approximately five times smaller than those used in the first automatic winding kinematic chain 3 of movement 1, where the velocity ratio between the barrel supplying the power reserve 36 and the oscillating weight is calculated. These ratios and the energy that can be stored will depend in particular upon the desired alarm vibration time, which could preferably be set between 10 and 20 seconds. The vibration time can be adjusted by the user, acting on winding wheel 47, by consulting a visual gauge coupled to barrel 46, which determines the level of energy stored in the barrel.

Figure 2:
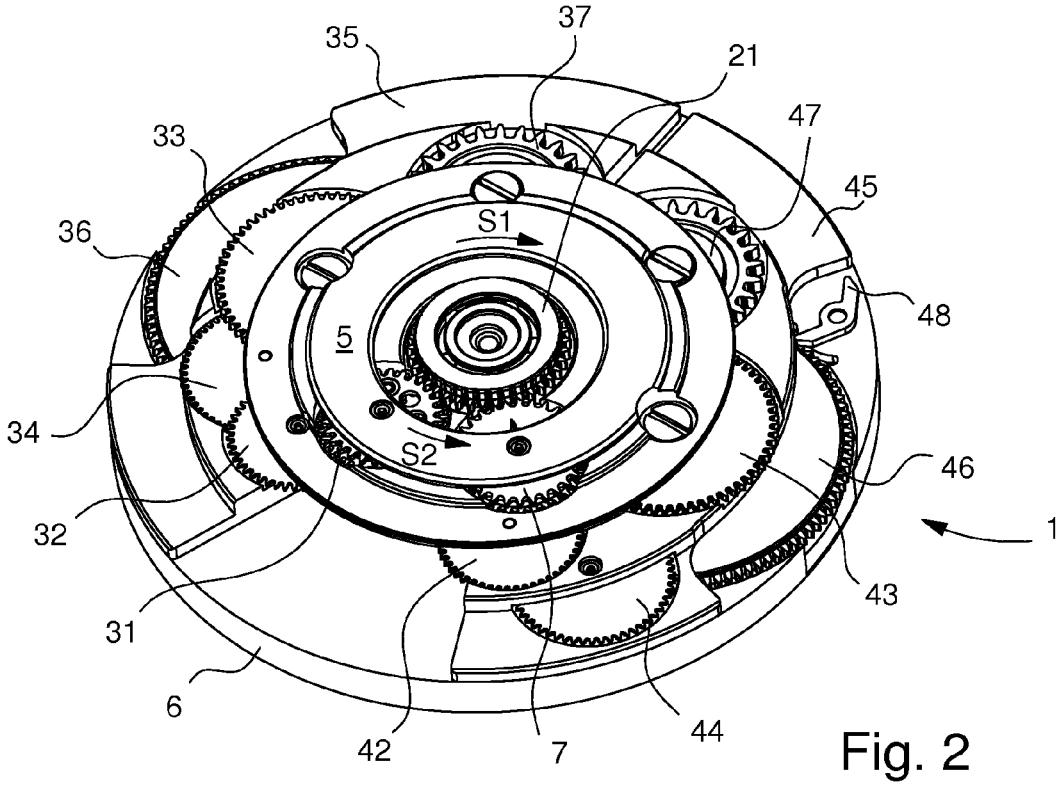
FIG. 2 is a perspective view of the movement of FIG. 1 once assembled.

FIG. 2 shows movement 1 of FIG. 1 when all of the parts have been assembled on bottom plate 6. Only oscillating weight 2 is not visible in order to show all of the parts that it covers once it is secured to weight pinion 21. Thus, only support 5 of oscillating weight 2 can be seen. As illustrated in FIG. 2, it can be seen that weight pinion 21 meshes both with reverser wheel 31 and coupling device 41, and more specifically first wheel set 311 of the reverser wheel and second wheel set 412 of coupling device 41. The fact that these two wheel sets 311 and 412 mesh directly with the weight pinion means that they always rotate in the same direction, which is opposite to the direction of rotation of oscillating weight 2. However, wheel set 311 is a driving wheel set, which causes the movement to be automatically wound when the oscillating weight rotates in a given direction of rotation S1, whereas wheel set 412 is a driven wheel set, which is activated in rotation when the energy from barrel 46 is released, but it never causes the second wheel 411 of the coupling mechanism to rotate. According to this embodiment, the direction of rotation S1 of the oscillating weight for automatically winding movement 1 is chosen to be the opposite of direction of rotation S2 of oscillating weight 2 when the alarm is activated. The fact that, via second kinematic chain 4, the mechanical energy from barrel 46 causes said oscillating weight 2 to rotate in the opposite direction to the direction that winds first barrel 36 via reverser wheel 31, allows the alarm to be activated, and consequently, for a given amount of energy stored in the barrel, provides a longer vibration period.

In FIG. 2, the elements numbered 31, 32, 34 form the automatic winding kinematic chain of movement 1, for storing mechanical energy in barrel 36. For a given direction of rotation S1, the first wheel set 311 of the reverser wheel drives the second wheel set 312 in rotation, which in turn drives the wheel of a first reduction wheel set 32, mounted on a bridge 35. The pinion of the first reduction wheel set 32, located underneath the wheel of the same wheel set 32, drives the wheel of the second reduction wheel set 34, which is rotatably mounted on the same bridge. The pinion of this second reduction wheel set 34, drives ratchet wheel 33 of the barrel. As indicated in the above description, ratchet wheel 33 of barrel 36 also meshes on the teeth of winding wheel 37, for manually winding movement 1. The second kinematic chain 44, 42, 41 converts the energy from barrel 46 into a rotation of oscillating weight 2. We start this time from barrel 46, which, once set in rotation as soon as click 48 is released from one of the teeth of the toothing, meshes with the pinion of reduction wheel set 44, located underneath the wheel of the same wheel set, visible in FIGS. 2 and 3, and which is rotatably mounted on reduction wheel set 42, also rotatably mounted on bridge 45. The wheel of this same wheel set meshes with the inertial click wheel 41, which forms the coupling mechanism according to a preferred embodiment of the invention and which will be described in detail with reference to the Figures below. The wheel of reduction wheel set 42 meshes more specifically on a pinion 417, illustrated below in FIG. 4, secured to the first wheel set 411 of coupling mechanism 41, which drives second wheel set 412 in rotation, forming the end of this kinematic chain. The second coupling mechanism wheel set 412 meshes, finally, with weight pinion 21 so as to rotate oscillating weight 2.

Unlike the automatic winding mechanism of movement 1 using kinematic chain 3, kinematic chain 4 thus releases the energy from barrel 46 rather than storing it inside. Thus, unlike the gear train associated with barrel 36, the alarm mechanism gear train does not have an automatic winding mechanism, but only a manual winding mechanism. Winding wheel 47, which meshes on ratchet wheel 43 of barrel 46, is used to achieve this, for example by activating an external knob, as explained in the above description. Although no automatic winding mechanism is provided in accordance with the preferred embodiment illustrated, it would, however, be possible to add one, for example via an additional gear train. This would however have the drawback of requiring more space in the case.

Figure 3:
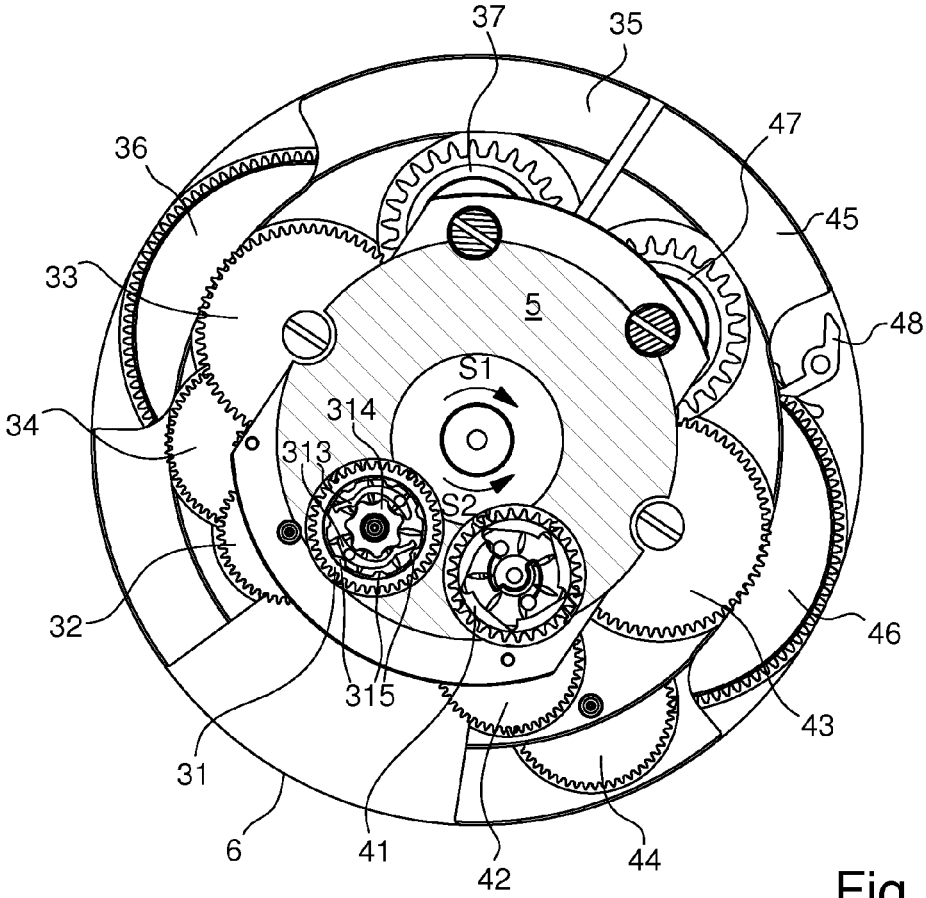
FIG. 3 is a top view of the movement of FIG. 1 in cross-section along the support for the oscillating weight.

FIG. 3 illustrates the movement of FIG. 2 in cross-section along oscillating weight support 5, to show the operation of coupling mechanism 41 according to the invention and the inside of reverser wheel 31 more clearly. All of the other constituent elements of the movement are identical to those illustrated in FIG. 2. As indicated previously, reverser wheel 31 meshes with weight pinion 21 of oscillating weight 2, but only activates the winding mechanism of movement 1 in one given direction of rotation of weight pinion 21, illustrated by the direction S1 in the Figure. The reverser wheel includes a first driving wheel set 311 and a wheel set 312, which is driven by a free wheel type click system. Studs, on which clicks 313 are mounted, are secured to first wheel set 311, whereas stop members 315 are formed at the periphery of second wheel set 312, which is also secured to a star-shaped hub 314 on its axis of rotation. The arms of click 313 cooperate with hub 314 and stop members 315 such that they drive the second wheel set in rotation in rotational direction S1, and are unclicked in the opposite direction S2.

The coupling mechanism 41 according to the preferred embodiment illustrated in this Figure consists of an inertial click wheel, of which the following elements can be seen in cross-section (NB: the references below are given with reference to FIG. 4, which is an enlargement of FIG. 3): a hub 415, at the centre, associated with the first coupling wheel set 411, to which flexible strips 414 are secured, with inertia-blocks 413 mounted on the end of said strips. When the first coupling wheel set 411 is driven in rotation by the action of reduction wheel set 42 on pinion 417, inertia-blocks 413 are drawn radially outwards. The flexibility of strips 414 enables these inertia-blocks 413 to move radially outwards; they are then meshed with stop members 416 secured to the second coupling wheel set, which is then driven in rotation. For the sake of legibility, the above references of the constituent elements of the inertial click wheel have not been added to FIG. 3, but only to the enlargement of that cross-sectional view shown in FIG. 4. FIGS. 5 and 6, explained below, also describe in detail different views of the coupling mechanism 41.

Figure 4:
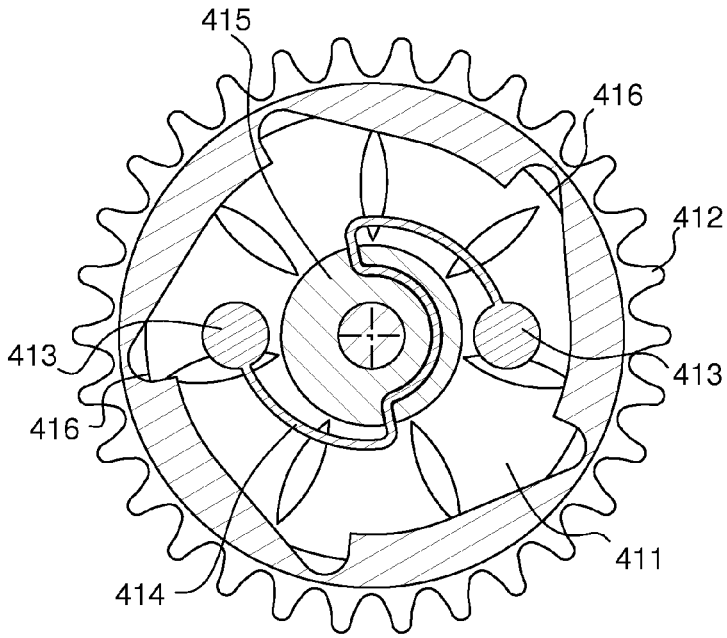
FIG. 4 is an enlargement of the cross-section of the coupling device according to the invention, seen in FIG. 3.
Figure 5:
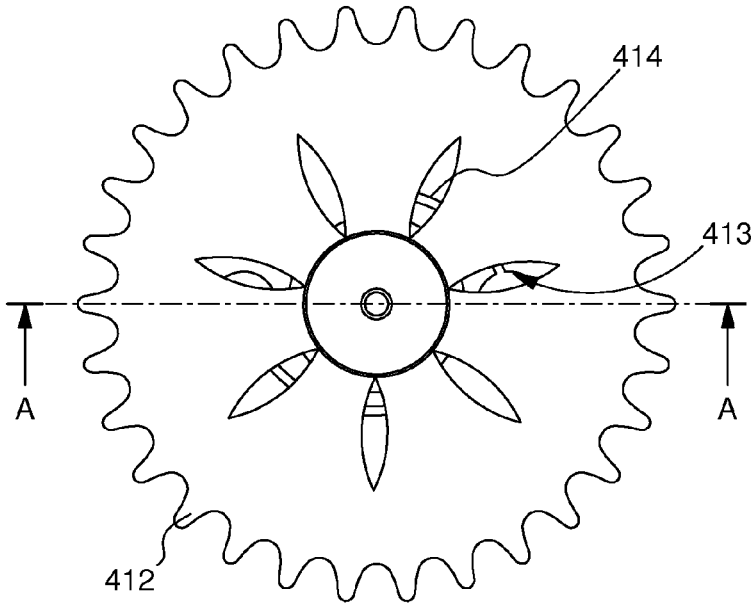
FIG. 5 is a top view of the coupling device of FIG. 4.
Figure 6:
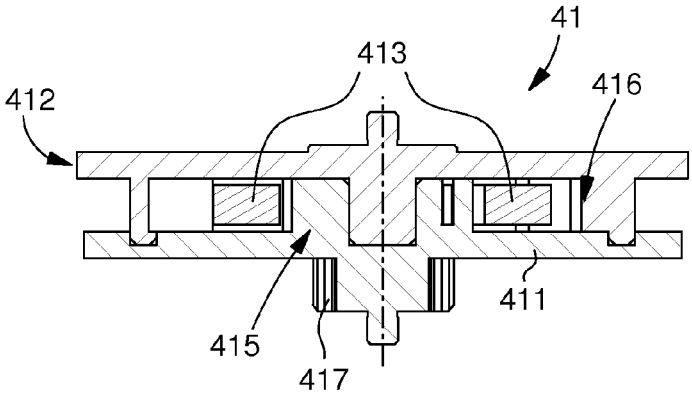
FIG. 6 is a sagittal cross-section of the coupling device of FIGS. 4 and 5.

FIGS. 4 to 6 show in more detail the operation of the inertial click wheel 41 according to the invention. FIG. 4 is an enlargement of FIG. 3 that focuses on coupling mechanism 41, formed by the illustrated inertial click wheel. More specifically, the Figure shows hub 415 at the centre, strips 414, inertia-blocks 413, which are secured to first wheel set 411, and stop members 416, secured to second wheel set 412, of which the external teeth, which will mesh on weight pinion 21, are shown. As will be seen below with reference to FIG. 6, stop members 416 and the teeth of the second coupling wheel set 412 are not located in the same plane. FIG. 5 shows this wheel set 412 specifically, in a top view, and the outer teeth thereof. Inertia-blocks 413 and flexible strips 414 can be seen through the hollows of wheel set 412. The coupling mechanism 41 thereby formed is a centrifugal coupling mechanism, including an inertial click formed by strips 414 and inertia-blocks 413, secured to hub 415 of the first coupling wheel set 411. Gearing only occurs with stop members 416, secured to second coupling wheel set 412, when strips 414 are sufficiently extended under the effect of the radial acceleration of inertia-blocks 413, which is determined by the rotational velocity of hub 415, which is also that of first wheel set 411. This velocity must be higher than a minimum threshold to ensure that strips 414 extend sufficiently to press the inertia-blocks against stop members 416. It could be adjusted by calculating, advisedly, amongst other things, the gear ratios of kinematic chain 4, and particularly those of reduction wheel sets 42, 44.

As can be seen in FIG. 4, stop members 416 are arranged in inertial click wheel 41, such that the first coupling wheel set 411 only drives the second coupling wheel set 412 in rotation in one given direction of rotation of first coupling wheel set 411, which is defined by the direction of rotation of barrel 46 when the spring is let down. The notches are oriented such that meshing is optimal when first wheel set 411 is rotating in the anti-clockwise direction. One could, however, imagine, in an alternative implementation, the stop members being arranged such that they allow second wheel set 412 to mesh and be coupled in rotation in any rotational direction of first wheel set 411, so that maximum flexibility is ensured for the assembly of the coupling mechanism and adaptation thereof to all existing types of movements 1, particularly in terms of bottom plates 6, barrel toothings 46 and the orientation of clicks 48.

FIG. 6 illustrates a cross-section along plane A-A visible in FIG. 5 of inertial click wheel 41. One can see pinion 417, underneath first coupling wheel set 411, and hub 415 and inertia-blocks 413 secured to first wheel set 411. On the top, forming a sort of cover on first wheel set 411, one can see second wheel set 412 and stop members 416 on the lateral external walls of inertial click wheel 41. This Figure clearly shows the relative driving-driven character of wheel sets 411 and 412 in relation to each other: the rotation of first coupling wheel set 411 causes the second coupling wheel set 412 to rotate, but rotation of the second coupling wheel set never causes the first coupling wheel set 411 to rotate. Consequently, when oscillating weight 2 moves, when the alarm mechanism is not being activated, the rotation of weight pinion 21 only causes second coupling wheel set 412 to rotate, and never has any influence on the rest of kinematic chain 4. Such a decoupling would have been impossible with a coupling mechanism of the type of the reverser wheel 31 previously described, in which the first wheel set 311 and second wheel set 312 can be each either driving or driven.

The man skilled in the art will appreciate that the coupling and decoupling features provided by the coupling mechanism 41 according to the invention allow to use it within other type of gear trains than the one of vibrating alarm using an oscillating weight 2 such as described, and which makes up only a preferred use pattern of this coupling mechanism. This mechanism could be used in particular in any gear train having a driving subset and a driven subset, wherein the driving subset contains at least a gearing element that can be driven at a relatively high rotation speed compared to the one of a base movement, i.e. several rotations per second, and wherein the driven subset such as a sound alarm mechanism actuating hammers, an scrolling mechanism e.g. with accelerated movement of hands or other indicators, etc. The energy source for the driving wheel set can be mechanical, as illustrated with the provided figures, as well as electrical.

LIST OF REFERENCES

| | |
|---|---|
| 1 | Movement |
| 2 | Oscillating weight |
| 21 | Weight pinion |
| 211 | Axis of rotation of the weight pinion |
| 3 | Kinematic chain for automatic winding |
| 31 | Reverser wheel |
| 311 | First wheel set of the reverser wheel |
| 312 | Second wheel set of the reverser wheel |
| 313 | Clicks secured to the first wheel set of the reverser wheel |
| 314 | Hub of the second wheel set of the reverser wheel |
| 315 | Peripheral stop members of the second reverser wheel |
| 32 | Reduction wheel set |
| 33 | Ratchet wheel of barrel 36 |
| 34 | Wheel of another reduction wheel set |
| 35 | First bridge secured to the bottom plate |
| 36 | Barrel of the automatic movement |
| 37 | Winding wheel for barrel 36 |
| 4 | Kinematic chain for the vibrating alarm mechanism |
| 41 | Coupling mechanism |
| 411 | First coupling wheel set |
| 412 | Second coupling wheel set |
| 413 | Inertia-blocks |
| 414 | Flexible strips |
| 415 | Hub of the first coupling wheel set |
| 416 | Stop members |
| 417 | Pinion secured to the first coupling wheel set |
| 42 | $1^{st}$ reduction wheel set |
| 43 | Ratchet wheel of the alarm barrel |
| 44 | $2^{nd}$ reduction wheel set |
| 45 | Second bridge secured to the bottom plate |
| 46 | Barrel for the vibrating alarm mechanism |
| 47 | Winding wheel for barrel 46 |
| 48 | Retaining click for the barrel toothing |
| 5 | Support for the oscillating weight |
| 6 | Bottom plate |
| 7 | Watch support |
| 8 | Element generating an acoustic signal |

What is claimed is:

1. A timepiece movement including:

a coupling mechanism, wherein the coupling mechanism is a centrifugal coupling mechanism that further comprises:

a first coupling wheel set having a hub;

a second coupling wheel set disposed so that rotation of the first coupling wheel set drives the second coupling wheel set in rotation;

an inertial click secured to the hub of the first coupling wheel set; and stop members secured to the second coupling wheel set, wherein the inertial click is operably disposed to press against the stop members when the first wheel set rotates.

2. The timepiece movement according to claim 1, wherein the first coupling wheel set only drives the second coupling wheel set in rotation in a single given direction.

3. The timepiece movement according to claim 2, wherein the first coupling wheel set is disposed to drives the second coupling wheel set in rotation, but the second wheel set is disposed to never drives the first coupling wheel set in rotation.

4. The timepiece movement according to claim 1, wherein the timepiece movement further includes an oscillating weight, and wherein the second coupling wheel set meshes with a weight pinion of the oscillating weight.

5. The timepiece movement according to claim 1, wherein the inertial click further comprises flexible strips and inertia blocks, wherein the flexible strips are secured to the hub of the first coupling wheel set.

6. The timepiece movement according to claim 5, wherein a rotation speed of the first coupling wheel set is higher than a minimum threshold to ensure that the flexible strips extend sufficiently to press the inertia-blocks against the stop members.

* * * * *